US011280207B2

(12) United States Patent
Shemyatovskiy et al.

(10) Patent No.: US 11,280,207 B2
(45) Date of Patent: Mar. 22, 2022

(54) ROTOR DISK ASSEMBLY FOR GAS TURBINE

(71) Applicant: DOOSAN HEAVY INDUSTRIES & CONSTRUCTION CO., LTD., Changwon-si (KR)

(72) Inventors: Victor Shemyatovskiy, Changwon-si (KR); Ja Won Seo, Daejeon (KR); Young Seok Heo, Changwon-si (KR)

( * ) Notice: Subject to any disclaimer, the term of this patent is extended or adjusted under 35 U.S.C. 154(b) by 459 days.

(21) Appl. No.: 16/148,068

(22) Filed: Oct. 1, 2018

(65) Prior Publication Data

US 2019/0112938 A1 Apr. 18, 2019

(30) Foreign Application Priority Data

Oct. 13, 2017 (KR) ..... 10-2017-0133238

(51) Int. Cl.
*F01D 11/00* (2006.01)
*F04D 29/32* (2006.01)
(Continued)

(52) U.S. Cl.
CPC ..... *F01D 11/006* (2013.01); *F01D 5/02* (2013.01); *F01D 5/066* (2013.01); *F01D 5/22* (2013.01);
(Continued)

(58) Field of Classification Search
CPC .... F01D 11/001; F01D 11/003; F01D 11/005; F01D 11/006; F01D 5/02; F01D 5/06;
(Continued)

(56) References Cited

U.S. PATENT DOCUMENTS 4,247,256 A * 1/1981 Maghon ..... F01D 5/066 416/198 A
4,500,098 A * 2/1985 Wilcox ..... F16J 15/164 277/641
(Continued)

FOREIGN PATENT DOCUMENTS

DE 102013005431 A1 10/2014
EP 1731718 A2 12/2006
(Continued)

OTHER PUBLICATIONS

An European Search Report dated Dec. 12, 2018 in connection with European Patent Application No. 18198878.3 which corresponds to the above-referenced U.S. application.
(Continued)

*Primary Examiner* — Justin D Seabe
*Assistant Examiner* — Julian B Getachew
(74) *Attorney, Agent, or Firm* — Harvest IP Law, LLP

(57) ABSTRACT

A rotor disk assembly for a gas turbine maintains a sealing capability even though adjacent labyrinth arms are dislocated from each other due to torsion or similar relative movement by thermal expansion or by rotation of the rotor disks of the gas turbine. The rotor disk assembly includes a plurality of rotor disks axially assembled to each other, the plurality of rotor disks including adjacent rotor disks coupled to each other by Hirth parts. Each rotor disk includes two labyrinth arms that extend axially and bilaterally and are located on the rotor disk more radially outward than the Hirth parts, and a first labyrinth arm of the two labyrinth arms having an end surface in which a receiving groove for receiving a seal ring is formed.

18 Claims, 6 Drawing Sheets

(51) Int. Cl.
*F01D 5/06* (2006.01)
*F01D 5/02* (2006.01)
*F01D 5/22* (2006.01)

(52) U.S. Cl.
CPC ..... *F01D 11/005* (2013.01); *F04D 29/321* (2013.01); *F05D 2220/321* (2013.01); *F05D 2240/24* (2013.01); *F05D 2240/55* (2013.01)

(58) Field of Classification Search
CPC ..... F01D 5/066; F01D 5/22; F04D 29/321; F05D 2220/321; F05D 2240/24; F05D 2240/50; F16J 15/062
See application file for complete search history.

(56) References Cited

U.S. PATENT DOCUMENTS 6,261,063 B1 * 7/2001 Chikami ..... F01D 5/066 416/198 A
7,549,845 B2 * 6/2009 Uwami ..... F01D 11/005 277/630
8,784,062 B2 * 7/2014 Suciu ..... F01D 5/027 416/198 A

FOREIGN PATENT DOCUMENTS

| | | | |
|---|---|---|---|
| EP | 3192967 | A1 | 7/2017 |
| EP | 3214266 | A1 | 9/2017 |
| EP | 3219911 | A1 | 9/2017 |
| JP | H10-274003 | A | 10/1998 |
| JP | 2012-117488 | A | 6/2012 |

OTHER PUBLICATIONS

A Korean Office Action dated Oct. 8, 2018 in connection with Korean Patent Application No. 10-2017-0133238 which corresponds to the above-referenced U.S. application.

* cited by examiner

[FIG. 1]
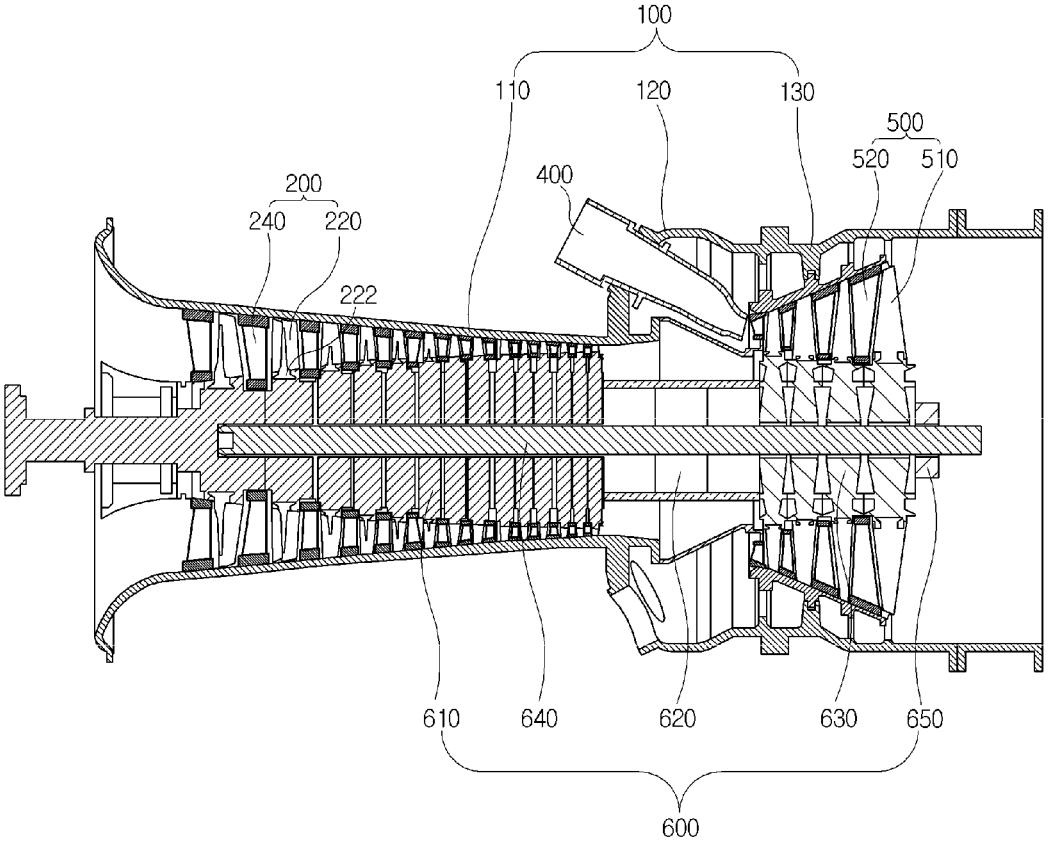

[FIG. 2]
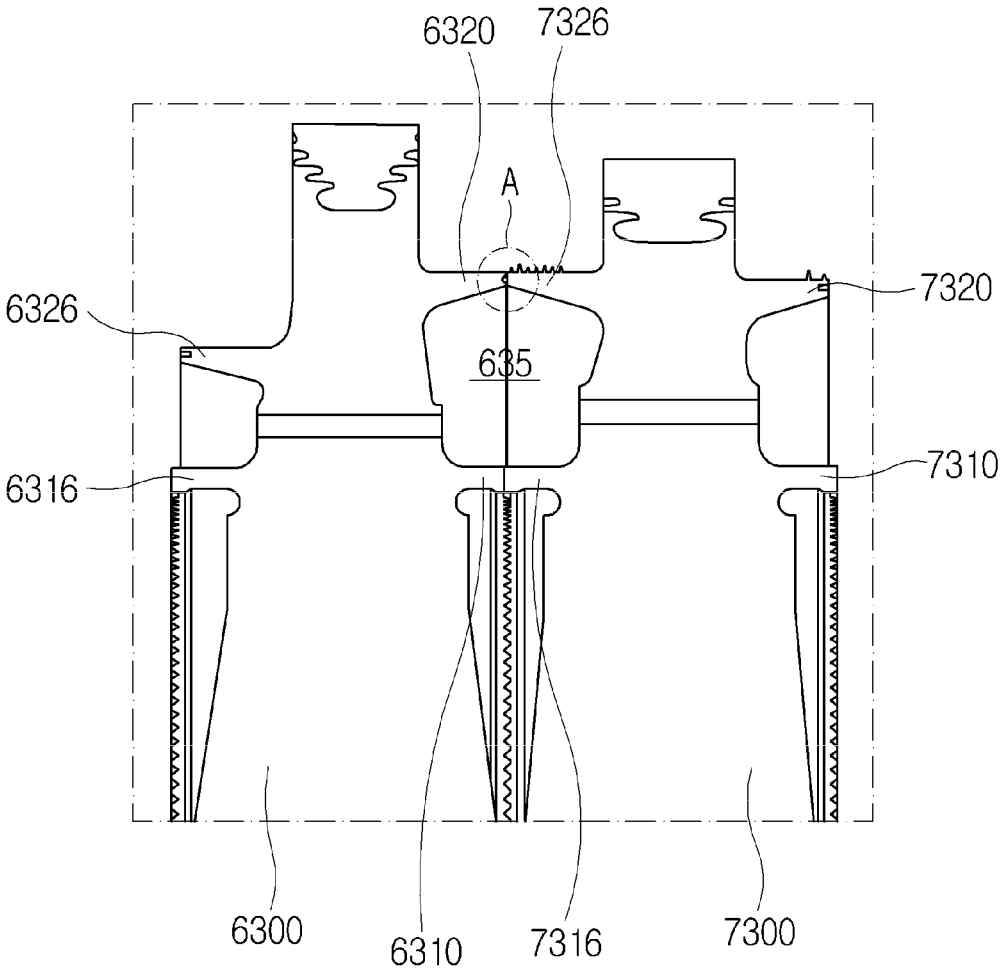

[FIG. 3]
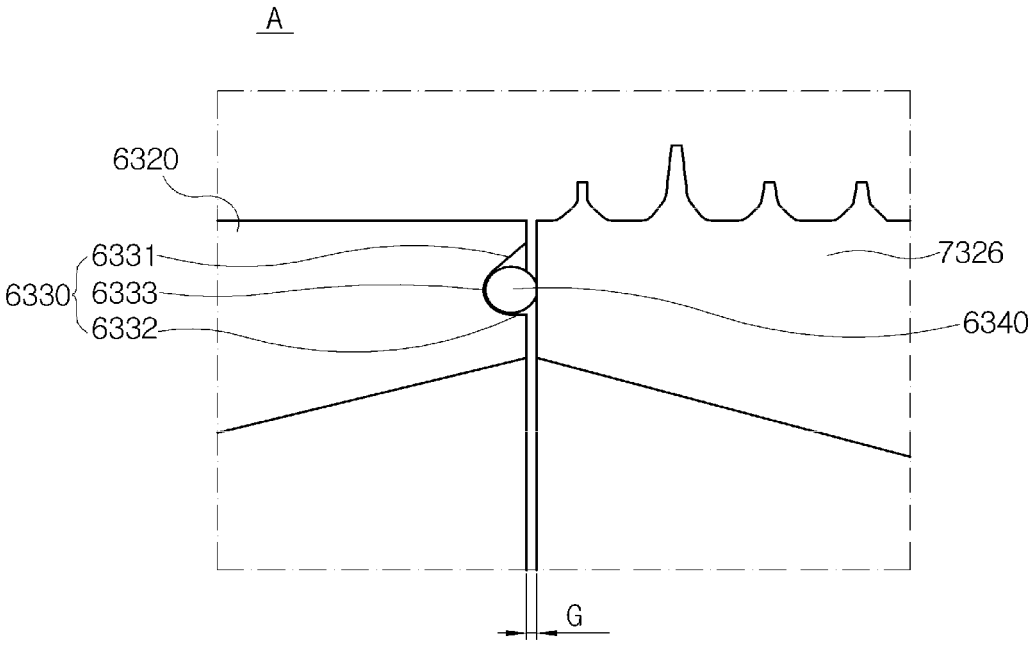

[FIG. 4]
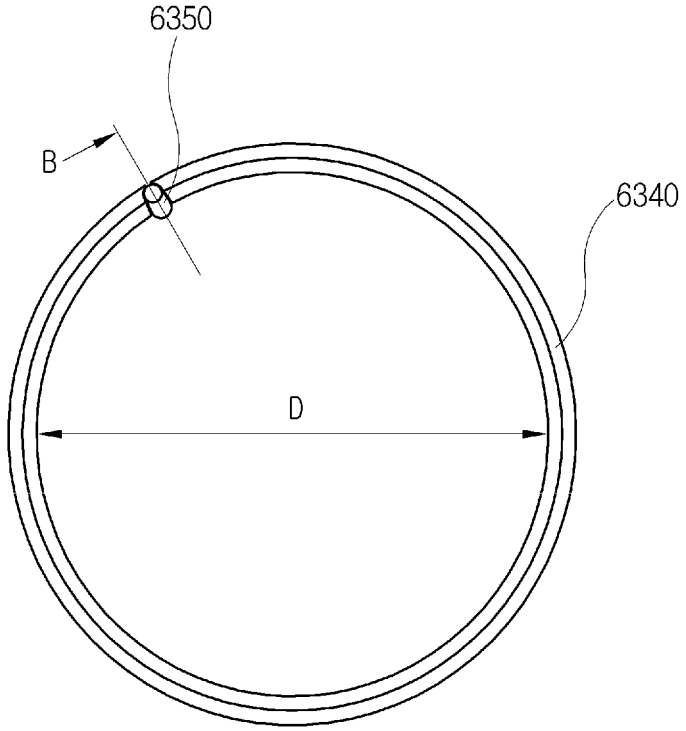

[FIG. 5]
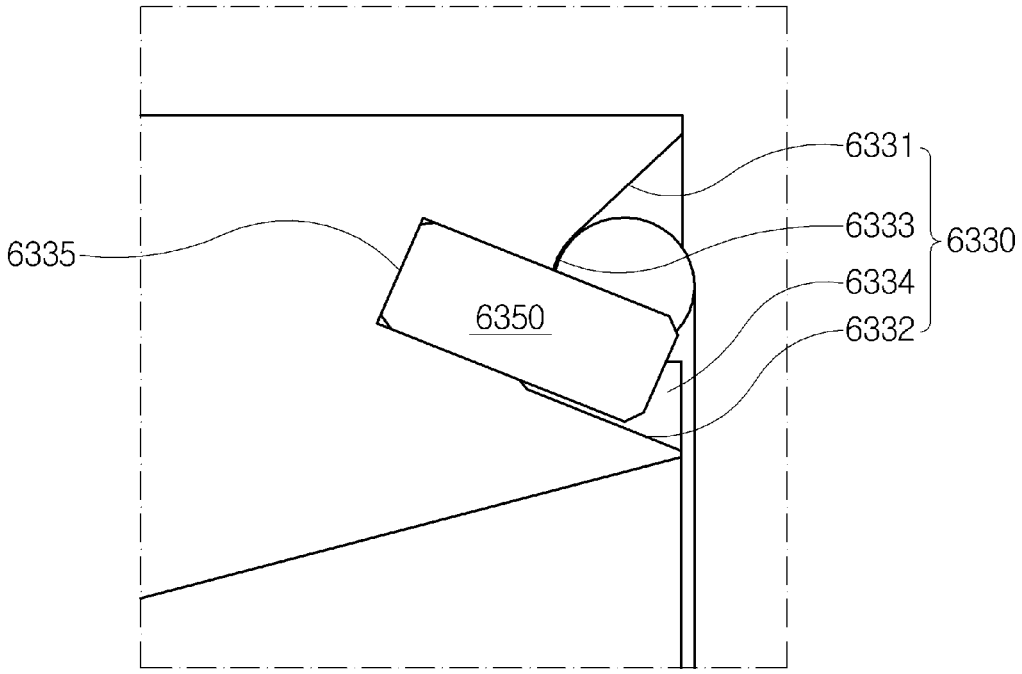

[FIG. 6]
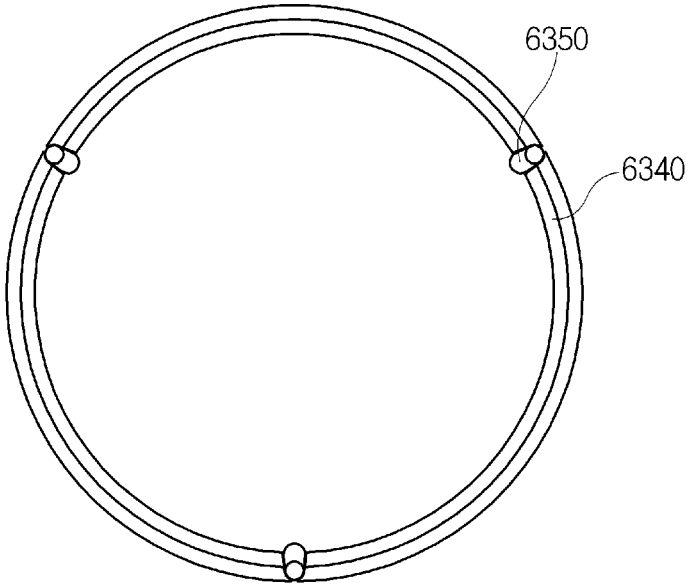

ROTOR DISK ASSEMBLY FOR GAS TURBINE

CROSS-REFERENCE TO RELATED APPLICATIONS

This application claims priority to Korean Patent Application No. 10-2017-0133238, filed on Oct. 13, 2017, the disclosure of which is incorporated herein by reference in its entirety.

BACKGROUND OF THE INVENTION

Field of the Invention

Exemplary embodiments of the present disclosure relate to a rotor disk assembly for a gas turbine, and more particularly to a rotor disk assembly in which each of a plurality of rotor disks includes a pair of labyrinth arms coupled together using a Hirth joint.

Description of the Related Art

In general, a turbine is a machine that converts the energy of a fluid such as water, gas, or steam into mechanical work, and is typically a turbomachine in which the fluid flows over many buckets or blades mounted to the circumference of a rotating body and thereby rotates the rotating body at high speed by impulsive or reaction force.

Examples of the turbine include a water turbine using the energy of elevated water, a steam turbine using the energy of steam, an air turbine using the energy of high-pressure compressed air, a gas turbine using the energy of high-temperature and high-pressure gas, and the like. Among these, the gas turbine includes a compressor, a combustor, turbine, and a rotor.

The compressor includes a plurality of compressor vanes and compressor blades arranged alternately. The combustor supplies fuel to air compressed by the compressor and ignites the fuel-air mixture with a burner to thereby produce high-temperature and high-pressure combustion gas. The turbine includes a plurality of turbine vanes and turbine blades arranged alternately.

The rotor passes through the centers of the compressor, combustor, and turbine. The rotor is rotatably supported at both ends by bearings, with one end connected to a drive shaft of a generator. The rotor includes a plurality of compressor rotor disks, each of which is fastened to the compressor blades; a plurality of turbine rotor disks, each of which is fastened to the turbine blades; and a torque tube that transmits rotational force from the turbine rotor disks to the compressor rotor disks.

In the above structure, air compressed by the compressor is mixed with fuel for combustion in the combustion chamber to produce hot combustion gas, the produced combustion gas is injected into the turbine, and the injected combustion gas generates rotational force while passing through the turbine blades, thereby rotating the rotor. This gas turbine is advantageous in that consumption of lubricant is extremely low due to the absence of mutual friction parts such as a piston-cylinder of a reciprocating mechanism in a four-stroke engine, in that the amplitude, which is a characteristic of reciprocating machines, is greatly reduced, and in that high-speed motion is enabled.

The gas turbine is typically designed such that the rotor disks are axially aligned with and assembled to each other and a seal member is inserted between labyrinth arms to prevent leakage of air inside and outside the disks. However, the seal member is conventionally inserted into each of a pair of recessed grooves respectively formed in opposing surfaces of two adjacently positioned labyrinth arms. Hence, when adjacent disks deform due to thermal expansion and become misaligned with each other, the seal member becomes dislocated or dislodged from its seating, which may lead to a loss of sealing capability.

SUMMARY OF THE INVENTION

An object of the present disclosure is to provide a rotor disk assembly for a gas turbine capable of enhancing a sealing capability.

Another object of the present disclosure is to provide a rotor disk assembly for a gas turbine capable of maintaining a sealing capability even though adjacent labyrinth arms are dislocated from each other due to torsion or similar relative movement by thermal expansion or by rotation of the rotor disks.

Other objects and advantages of the present disclosure can be understood by the following description, and become apparent with reference to the embodiments of the present disclosure. Also, it is obvious to those skilled in the art to which the present disclosure pertains that the objects and advantages of the present disclosure can be realized by the means as claimed and combinations thereof.

In accordance with one aspect of the present disclosure, there is provided a rotor disk assembly for a gas turbine. The rotor disk assembly may include a plurality of rotor disks axially assembled to each other, the plurality of rotor disks including adjacent rotor disks coupled to each other by Hirth parts, each rotor disk including two labyrinth arms that extend axially and bilaterally and are located on the rotor disk more radially outward than the Hirth parts, and a first labyrinth arm of the two labyrinth arms having an end surface in which a receiving groove for receiving a seal ring is formed.

The other of the two labyrinth arms may have a flat end, and a gap may be formed between the flat end of the other labyrinth arm and the end surface of the first labyrinth arm of an adjacent rotor disk of the plurality of rotor disks.

The seal ring may have a size greater than a depth of the receiving groove, and a difference between the sizes of the seal ring the depth of the receiving groove may be greater than a distance of the gap.

The receiving groove may be narrowed inward from an end of the first labyrinth arm.

The receiving groove may have an axially cut cross-section having a conical shape.

The receiving groove of the first labyrinth arm may have a vertex recessed by an insertion groove for receiving a rotation prevention pin.

The rotation prevention pin may consist of a plurality of rotation prevention pins arranged according to a certain circumferential interval around the seal ring.

The receiving groove may include a first inclined surface formed on a radially outward side of the receiving groove; a second inclined surface formed on a radially inward side of the receiving groove; and a vertex at which the first and second inclined surfaces meet.

The seal ring may be an elastic body.

The seal ring may be configured to cover the gap while increasing radially when a rotor rotates.

In accordance with another aspect of the present disclosure, there is provided a rotor disk for a gas turbine. The rotor disk may include a disk plate; Hirth parts circumferentially formed on front and rear surfaces of the disk plate to be coupled to an adjacent disk plate; and labyrinth arms circumferentially formed on the disk plate to be located more radially outward than the Hirth parts, wherein the labyrinth arms comprise a first labyrinth arm formed on the front surface of the disk plate and a second labyrinth arm formed on the rear surface of the disk plate, the first labyrinth arm having an end surface in which a receiving groove for receiving a seal ring is formed and the second labyrinth arm having a flat end for facing the end surface of the first labyrinth arm of the adjacent disk plate. The seal ring may have a size greater than a depth of the receiving groove, and a difference between the size of the seal ring the depth of the receiving groove may be greater than a distance of a gap formed between the flat end of the second labyrinth arm and the end surface of the first labyrinth arm of the adjacent rotor disk.

A pressure cavity may be defined between the labyrinth arms and the Hirth parts.

It is to be understood that both the foregoing general description and the following detailed description of the present disclosure are exemplary and explanatory and are intended to provide further explanation of the disclosure as claimed.

BRIEF DESCRIPTION OF THE DRAWINGS

The above and other objects, features and other advantages of the present disclosure will be more clearly understood from the following detailed description taken in conjunction with the accompanying drawings, in which:

FIG. 1 is a cross-sectional view illustrating a gas turbine to which an embodiment of the present disclosure may be applied;

FIG. 2 is a cross-sectional view illustrating a rotor disk assembly according to the embodiment of the present disclosure;

FIG. 3 is an enlarged view of portion A of FIG. 2;

FIG. 4 is a front view illustrating a seal ring according to the embodiment of the present disclosure;

FIG. 5 is a cross-sectional view illustrating the seal ring having a rotation prevention pin, when viewed in direction B of FIG. 4; and FIG. 6 is a front view illustrating a seal ring having a plurality of rotation prevention pins according to another embodiment of the present disclosure.

DESCRIPTION OF SPECIFIC EMBODIMENTS

Reference will now be made in detail to exemplary embodiments of the present disclosure, examples of which are illustrated in the accompanying drawings. The present disclosure may, however, be embodied in different forms and should not be construed as limited to the embodiments set forth herein. Rather, these embodiments are provided so that this disclosure will be thorough and complete, and will fully convey the scope of the present disclosure to those skilled in the art. Throughout the disclosure, like reference numerals refer to like parts throughout the various figures and embodiments of the present disclosure.

Hereinafter, a gas turbine adopting exemplary embodiments of the present disclosure will be described in detail with reference to the accompanying drawings.

FIG. 1 illustrates a gas turbine, which may include, as shown in FIG. 2, two adjacent rotor disks 6300 and 7300 according to an embodiment of the present disclosure.

Referring to FIG. 1, the gas turbine of the present disclosure may include a housing 100, a rotor 600 that is rotatably provided in the housing 100, a compressor 200 that compresses air introduced into the housing 100 by the rotational force transmitted from the rotor 600, a combustor 400 that produces combustion gas by mixing fuel with the air compressed in the compressor 200 and igniting the mixture, a turbine 500 that rotates the rotor 600 by the rotational force obtained from the combustion gas produced in the combustor 400, a generator (not shown) that is operatively connected to the rotor 600 for power generation, and a diffuser that discharges the combustion gas having passed through the turbine 500.

The housing 100 may include a compressor housing 110 that accommodates the compressor 200, a combustor housing 120 that accommodates the combustor 400, and a turbine housing 130 that accommodates the turbine 500. Here, the compressor housing 110, the combustor housing 120, the turbine housing 130 may be subsequently arranged from upstream to downstream in the flow direction of fluid.

The rotor 600 may include a compressor rotor disk 610 that is accommodated in the compressor housing 110, a turbine rotor disk 630 that is accommodated in the turbine housing 130, a torque tube 620 that is accommodated in the combustor housing 120 to connect the compressor rotor disk 610 and the turbine rotor disk 630, and a tie rod 640 and a fixing nut 650 that fasten the compressor rotor disk 610, the torque tube 620, and the turbine rotor disk 630 to one another.

The compressor rotor disk 610 may consist of a plurality of compressor rotor disks arranged in the axial direction of the rotor 600. That is, the compressor rotor disks 610 may be formed in a multistage manner. Each of the compressor rotor disks 610 may have a substantially disk shape, and may have a compressor blade coupling slot formed in the outer peripheral portion such that a compressor blade 210 to be described later is coupled to the compressor blade coupling slot. The compressor blade coupling slot may have a fir-tree shape to prevent the decoupling of the compressor blade 210 from the compressor blade coupling slot in the radial direction of the rotor 600.

Here, the compressor rotor disk 610 is typically coupled to the compressor blade 210 in a tangential-type or axial-type manner. In the present embodiment, they are coupled to each other in the axial-type manner. Thus, the compressor blade coupling slot according to the present embodiment may consist of a plurality of compressor blade coupling slots arranged radially in the circumferential direction of the compressor rotor disk 610.

The turbine rotor disk 630 may be formed similar to the compressor rotor disk 610. That is, the turbine rotor disk 630 may consist of a plurality of turbine rotor disks arranged in the axial direction of the rotor 600. In other words, the turbine rotor disks 630 may be formed in a multistage manner. Each of the turbine rotor disks 630 may have a substantially disk shape, and may have a turbine blade coupling slot formed in the outer peripheral portion thereof such that a turbine blade 510 to be described later is coupled to the turbine blade coupling slot. The turbine blade coupling slot may have a fir-tree shape to prevent the decoupling of the turbine blade 510 from the turbine blade coupling slot in the radial direction of the rotor 600.

Here, the turbine rotor disk 630 is typically coupled to the turbine blade 510 in a tangential-type or axial-type manner. In the present embodiment, they are coupled to each other in the axial-type manner. Thus, the turbine blade coupling slot according to the present embodiment may consist of a plurality of turbine blade coupling slots arranged radially in the circumferential direction of the turbine rotor disk 630.

The torque tube 620 is a torque transmission member that transmits the rotational force of the turbine rotor disk 630 to the compressor rotor disk 610. One end of the torque tube 620 may be fastened to a compressor rotor disk 610, which is positioned at the most downstream side in the flow direction of air, from among the plurality of compressor rotor disks 610, and the other end of the torque tube 620 may be fastened to a turbine rotor disk 630, which is positioned at the most upstream side in the flow direction of combustion gas, from among the plurality of turbine rotor disks 630. Here, the torque tube 620 may have a protrusion formed at each end, and each of the compressor rotor disk 610 and the turbine rotor disk 630 may have a groove respectively engaged with the corresponding protrusion. Thus, it is possible to prevent the torque tube 620 from rotating relative to the compressor rotor disk 610 and the turbine rotor disk 630. The torque tube 620 may have a hollow cylindrical shape such that the air supplied from the compressor 200 flows to the turbine 500 through the torque tube 620. The torque tube 620 may be formed to be resistant to deformation and distortion due to the characteristics of the gas turbine that continues to operate for a long time, and may be easily assembled and disassembled for easy maintenance.

The tie rod 640 may be formed to pass through the plurality of compressor rotor disks 610, the torque tube 620, and the plurality of turbine rotor disks 630. One end of the tie rod 640 may be fastened to the farthest upstream compressor rotor disk 610 among the plurality of compressor rotor disks 610, and the other end of the tie rod 640 may protrude in a direction opposite to the compressor 200 with respect to the farthest downstream turbine rotor disk 630 among the plurality of turbine rotor disks 630, to be fastened to the fixing nut 650.

Here, the fixing nut 650 presses the farthest downstream turbine rotor disk 630 toward the compressor 200 to reduce the distance between the farthest upstream compressor rotor disk 610 and the farthest downstream turbine rotor disk 630. Thus, the plurality of compressor rotor disks 610, the torque tube 620, and the plurality of turbine rotor disks 630 may be compressed in the axial direction of the rotor 600. Therefore, it is possible to prevent the axial movement and relative rotation of the plurality of compressor rotor disks 610, the torque tube 620, and the plurality of turbine rotor disks 630.

Although one tie rod 640 is formed to pass through the centers of the plurality of compressor rotor disks 610, the torque tube 620, and the plurality of turbine rotor disks 630 in the present embodiment, the present disclosure is not limited thereto. That is, a separate tie rod 640 may be provided in each of the compressor 200 and the turbine 500, a plurality of tie rods 640 may be arranged circumferentially and radially, or a combination thereof may be used.

Through such a configuration, the rotor 600 may be rotatably supported at both ends by bearings, with one end connected to the drive shaft of the generator.

The compressor 200 may include a compressor blade 210 that rotates together with the rotor 600, and a compressor vane 220 that is fixedly installed in the housing 100 to align the flow of air introduced into the compressor blade 210. The compressor blade 210 may consist of a plurality of compressor blades arranged in a multistage manner in the axial direction of the rotor 600, and the plurality of compressor blades 210 may be formed radially in the direction of rotation of the rotor 600 for each stage. Each of the compressor blades 210 may include a plate-shaped compressor blade platform, a compressor blade root that extends inward from the compressor blade platform in the radial direction of the rotor 600, and a compressor blade airfoil that extends outward from the compressor blade platform in the radial direction of the rotor 600. One compressor blade platform may be in contact with a compressor blade platform adjacent thereto, in order to maintain the distance between one compressor blade airfoil and another compressor blade airfoil. The compressor blade root may be formed in a so-called axial-type manner in which the compressor blade root is inserted into the above-mentioned compressor blade coupling slot in the axial direction of the rotor 600. In this case, the compressor blade root may have a fir-tree shape so as to correspond to the compressor blade coupling slot.

Although the compressor blade root and the compressor blade coupling slot have a fir-tree shape in the present embodiment, the present disclosure is not limited thereto. For example, they may also have a dovetail shape or the like. In addition, the compressor blade 210 may be fastened to the compressor rotor disk 610 using a fastener other than the above form, for example using a fixture such as a key or a bolt.

In order to easily fasten the compressor blade root to the compressor blade coupling slot, the compressor blade coupling slot may be larger than the compressor blade root such that, in a coupled state, a gap may exist between the compressor blade root and the compressor blade coupling slot.

Although not separately illustrated in the drawings, the compressor blade root may be fixed to the compressor blade coupling slot by a separate pin to prevent the decoupling of the compressor blade root from the compressor blade coupling slot in the axial direction of the rotor 600.

The compressor blade airfoil may have an optimized airfoil shape according to the specifications of the gas turbine and may include a leading edge facing the flow of air such that air strikes the leading edge, and a trailing edge positioned in the downstream direction such that air flows from the trailing edge.

The compressor vane 220 may consist of a plurality of compressor vanes formed in a multistage manner in the axial direction of the rotor 600. Here, the compressor vane 220 and the compressor blade 210 may be arranged alternately in the flow direction of air. The plurality of compressor vanes 220 may be formed radially in the direction of rotation of the rotor 600 for each stage. Each of the compressor vanes 220 may include an annular compressor vane platform that is formed in the direction of rotation of the rotor 600, and a compressor vane airfoil that extends from the compressor vane platform in the radial direction of the rotor 600. The compressor vane platform may include a root-side compressor vane platform that is formed at the airfoil root portion of the compressor vane airfoil to be fastened to the compressor housing 110, and a tip-side compressor vane platform that is formed at the airfoil tip portion of the compressor vane airfoil to face the rotor 600.

Although the compressor vane platform includes the root-side compressor vane platform and the tip-side compressor vane platform to more stably support the compressor vane airfoil by supporting the airfoil tip portion of the compressor vane airfoil as well as the airfoil root portion thereof in the present embodiment, the present disclosure is not limited thereto. That is, the compressor vane platform may also include a root-side compressor vane platform to support only the airfoil root portion of the compressor vane airfoil.

The compressor vane airfoil may have an optimized airfoil shape according to the specifications of the gas turbine and may include a leading edge facing the flow of air such that air strikes the leading edge, and a trailing edge positioned in the downstream direction such that air flows from the trailing edge.

The combustor 400 may mix the air introduced from the compressor 200 with fuel and burn the mixture to produce high-temperature and high-pressure combustion gas with high energy. The combustor 400 may increase the temperature of the combustion gas to a temperature at which the combustor 400 and turbine 500 are able to be resistant to heat in a constant-pressure combustion process.

In detail, the combustor 400 may consist of a plurality of combustors arranged in the direction of rotation of the rotor 600 in the combustor housing 120. Each of the combustors 400 may include a liner into which the air compressed by the compressor 200 is introduced, a burner that injects fuel into the air introduced into the liner for combustion, and a transition piece that guides the combustion gas produced by the burner to the turbine 500. The liner may include a flame container that defines a combustion chamber, and a flow sleeve that surrounds the flame container and defines an annular space. The burner may include a fuel injection nozzle that is formed at the front end of the liner to inject fuel into the air introduced into the combustion chamber, and an ignition plug that is formed on the wall of the liner to ignite the fuel-air mixture in the combustion chamber. The transition piece may be configured such that its outer wall is cooled by the air supplied from the compressor 200 to prevent damage to the transition piece by the high temperature of combustion gas. That is, the transition piece may have a cooling hole for introducing air to the main body of the transition piece, which is cooled by the air introduced through the cooling hole. The air used to cool the transition piece may flow into the annular space of the liner and may impinge on cooling air supplied through the cooling hole formed in the flow sleeve from the outside of the flow sleeve in the outer wall of the liner.

Although not separately illustrated in the drawings, a desworler serving as a guide vane may be formed between the compressor 200 and the combustor 400 to adapt the angle of flow of air, introduced into the combustor 400, to a design angle of flow.

The turbine 500 may be formed similar to the compressor 200. That is, the turbine 500 may include a turbine blade 510 that rotates together with the rotor 600, and a turbine vane 520 that is fixedly installed in the housing 100 to align the flow of air introduced into the turbine blade 510. The turbine blade 510 may consist of a plurality of turbine blades arranged in a multistage manner in the axial direction of the rotor 600, and the plurality of turbine blades 510 may be formed radially in the direction of rotation of the rotor 600 for each stage. Each of the turbine blades 510 may include a plate-shaped turbine blade platform, a turbine blade root that extends inward from the turbine blade platform in the radial direction of the rotor 600, and a turbine blade airfoil that extends outward from the turbine blade platform in the radial direction of the rotor 600. One turbine blade platform may be in contact with an adjacent turbine blade platform, in order to maintain the distance between one turbine blade airfoil and another turbine blade airfoil. The turbine blade root may be formed in a so-called axial-type manner in which the turbine blade root is inserted into the above-mentioned turbine blade coupling slot in the axial direction of the rotor 600. The turbine blade root may have a fir-tree shape so as to correspond to the turbine blade coupling slot.

Although the turbine blade root and the turbine blade coupling slot have a fir-tree shape in the present embodiment, the present disclosure is not limited thereto. For example, they may also have a dovetail shape or the like. In addition, the turbine blade 510 may be fastened to the turbine rotor disk 630 using a fastener other than the above form, for example using a fixture such as a key or a bolt.

In order to easily fasten the turbine blade root to the turbine blade coupling slot, the turbine blade coupling slot may be larger than the turbine blade root such that, in a coupled state, a gap may exist between the turbine blade root and the turbine blade coupling slot.

Although not separately illustrated in the drawings, the turbine blade root may be fixed to the turbine blade coupling slot by a separate pin to prevent the decoupling of the turbine blade root from the turbine blade coupling slot in the axial direction of the rotor 600.

The turbine blade airfoil may have an optimized airfoil shape according to the specifications of the gas turbine and may include a leading edge facing the flow of combustion gas, and a trailing edge positioned in the downstream such that combustion gas flows from the trailing edge.

The turbine vane 520 may consist of a plurality of turbine vanes formed in a multistage manner in the axial direction of the rotor 600. Here, the turbine vane 520 and the turbine blade 510 may be arranged alternately in the flow direction of air. The plurality of turbine vanes 520 may be formed radially in the direction of rotation of the rotor 600 for each stage. Each of the turbine vanes 520 may include an annular turbine vane platform that is formed in the direction of rotation of the rotor 600, and a turbine vane airfoil that extends from the turbine vane platform in the direction of rotation of the rotor 600. The turbine vane platform may include a root-side turbine vane platform that is formed at the airfoil root portion of the turbine vane airfoil to be fastened to the turbine housing 130, and a tip-side turbine vane platform that is formed at the airfoil tip portion of the turbine vane airfoil to face the rotor 600.

Although the turbine vane platform includes the root-side turbine vane platform and the tip-side turbine vane platform to more stably support the turbine vane airfoil by supporting the airfoil tip portion of the turbine vane airfoil as well as the airfoil root portion in the present embodiment, the present disclosure is not limited thereto. That is, the turbine vane platform may also include a root-side turbine vane platform to support only the airfoil root portion of the turbine vane airfoil.

The turbine vane airfoil may have an optimized airfoil shape according to the specifications of the gas turbine and may include a leading edge facing the flow of combustion gas, and a trailing edge positioned in the downstream direction such that combustion gas flows from the trailing edge.

Since, unlike the compressor 200, the turbine 500 comes into contact with high-temperature and high-pressure combustion gas, there is a need for a cooling means for preventing damage such as deterioration. Thus, the gas turbine of the present disclosure may further include a cooling passage through which some of the air compressed in the compressor 200 is bled to be supplied to the turbine 500. The cooling passage may extend outside the housing 100 (external passage), may extend through the inside of the rotor 600 (internal passage), or may use both of the external passage and the internal passage. The cooling passage may communicate with a turbine blade cooling passage formed in the turbine blade 510 such that the turbine blade 510 is cooled by cooling air. The turbine blade cooling passage may communicate with a turbine blade film cooling hole formed in the surface of the turbine blade 510 so that cooling air is supplied to the surface of the turbine blade 510, thereby enabling the turbine blade 510 to be cooled by the cooling air in a so-called film cooling manner. The turbine vane 520 may also be cooled by the cooling air supplied from the cooling passage, similar to the turbine blade 510.

Meanwhile, the turbine 500 requires a gap between the blade tip of the turbine blade 510 and the inner peripheral surface of the turbine housing 130 such that the turbine blade 510 is smoothly rotatable. While a large gap is advantageous in terms of prevention of interference between the turbine blade 510 and the turbine housing 130, it is disadvantageous in terms of leakage of combustion gas as the gap is large, and vice versa or a gap that is small. That is, the flow of combustion gas injected from the combustor 400 may be sorted into a main flow in which combustion gas flows through the turbine blade 510, and a leakage flow in which combustion gas flows through the gap between the turbine blade 510 and the turbine housing 130. The leakage flow increases for larger gaps, which can prevent interference between the turbine blade 510 and the turbine housing 130 due to thermal deformation or the like and thus damage though the efficiency of the gas turbine is reduced. On the other hand, the leakage flow decreases for smaller gaps, which enhances the efficiency of the gas turbine but may lead to interference between the turbine blade 510 and the turbine housing 130 due to thermal deformation or the like and may thus lead to damage.

Accordingly, the gas turbine of the present disclosure may further include a sealing means for securing an appropriate gap to minimize a reduction in gas turbine efficiency while preventing the interference between the turbine blade 510 and the turbine housing 130 and thus damage. The sealing means may include a shroud that is positioned at the blade tip of the turbine blade 510, a labyrinth seal that protrudes outward from the shroud in the radial direction of the rotor 600, and a honeycomb seal that is installed on the inner peripheral surface of the turbine housing 130. The sealing means having such a configuration may form an appropriate gap between the labyrinth seal and the honeycomb seal to minimize a reduction in gas turbine efficiency due to the leakage of combustion gas and to prevent the direct contact between the high-speed rotating shroud and the fixed honeycomb seal and to thus prevent damage.

The turbine 500 may further include a sealing means for blocking the leakage between the turbine vane 520 and the rotor 600. To this end, a brush seal and the like may be used in addition to the above labyrinth seal.

In the gas turbine having such a configuration, air introduced into the housing 100 may be compressed by the compressor 200, the air compressed by the compressor 200 may be mixed with fuel for combustion and then be converted into combustion gas in the combustor 400, the combustion gas produced by the combustor 400 may be introduced into the turbine 500, the combustion gas introduced into the turbine 500 may rotate the rotor 600 through the turbine blade 510 and then be discharged to the atmosphere through the diffuser, and the rotor 600 rotated by the combustion gas may drive the compressor 200 and the generator. That is, some of the mechanical energy obtained from the turbine 500 may be supplied as energy required for compression of air in the compressor 200, and the remainder may be used to produce electric power by the generator.

Meanwhile, a gas turbine as constructed above may include a rotor disk assembly as illustrated in FIG. 2.

Referring to FIG. 2, adjacent rotor disks of the gas turbine include a first rotor disk 6300 and a second rotor disk 7300, which are coupled to each other by Hirth parts 6310, 6316, 7310, and 7316. When joined together by the juxtapositioning of two adjacent rotor disks of the gas turbine, Hirth parts 6310 and 7316 form one Hirth joint, while Hirth parts 6316 and 7310 may form another Hirth joint. A pressure cavity 635 is formed radially between corresponding Hirth parts. Labyrinth arms 6320, 6326, 7320, and 7326 are formed on the rotor disk 6300 to be located more radially outward than the Hirth parts.

The first rotor disk 6300 of the adjacent rotor disks includes a first labyrinth arm 6320 having a grooved end in which a small groove is formed, and a second labyrinth arm 6326 having a flat end. The second rotor disk 7300 of the adjacent rotor disks includes a third labyrinth arm 7320 corresponding to the first labyrinth arm 6320 and a fourth labyrinth arm 7326 facing the first labyrinth arm 6320.

The contact of a pair of opposing labyrinth arms, occurring at portion A of FIG. 2, refers to a sealing portion that seals a gap between the pressure cavity 635 and the outside of the disks for air tightness. This is illustrated in more detail in FIG. 3.

As illustrated in FIG. 3, the first labyrinth arm 6320 has an end surface in which a receiving groove 6330 for receiving a seal ring 6340 is formed. The receiving groove 6330 may have a shape corresponding to the cross-section of the seal ring 6340.

The cross-section of the seal ring 6340 may be curved to have a circular or semicircular shape or may be polygonal to have a triangular or square shape.

The seal ring 6340 may have a size greater than the depth of the receiving groove 6330 to cover a gap G between the first labyrinth arm 6320 and the fourth labyrinth arm 7326 even though the rotor does not rotate when it is located in the receiving groove 6330. That is, the difference between the size of the seal ring 6340 and the depth of the receiving groove 6330 is greater than the distance of the gap G.

The receiving groove 6330 includes a first inclined surface 6331 formed on a radially outward side of the receiving groove 6330, a second inclined surface 6332 formed on a radially inward side of the receiving groove 6330, and a vertex 6333 at which the first and second inclined surfaces 6331 6332 meet. The first and second inclined surfaces 6331 and 6332 and the vertex 6333 form a shape suitable for receiving the seal ring 6340. Thus, the receiving groove 6330 has an axially cut cross-section having a conical shape.

Preferably, the first inclined surface 6331 extends from the vertex 6333 toward the radially outward side of the first labyrinth arm 6320, that is, radially outward with respect to the rotor. This structure functions to more effectively seal the gap G between the first labyrinth arm 6320 and the fourth labyrinth arm 7326 as the seal ring 6340 expands or deforms in the radially outward direction in reaction to a centrifugal force created by the rotation of the rotor. That is, when the centrifugal force is applied to the seal ring 6340 according to the rotation of the rotor, the seal ring 6340 slides or increases to come into stronger contact with the flat end of the fourth labyrinth arm 7326. Thus, a sealing capability is further increased as the rotation of the rotor is increased.

FIG. 4 illustrates the seal ring 6340 in more detail. The seal ring 6340 is formed in a circular shape that has a diameter D, and has a rotation prevention pin 6350 disposed at one side. Although the seal ring 6340 is preferably an elastic body, it may be an inelastic body.

As illustrated in FIG. 5, the rotation prevention pin 6350 is fixedly inserted into an insertion groove 6335 that is additionally recessed in the vertex 6333 of the receiving groove 6330. The vertex 6333 of the receiving groove 6330 of the first labyrinth arm 6320 is recessed by the insertion groove 6335 in order to receive the rotation prevention pin 6350.

To this end, a stepped portion 6334 is formed outside the second inclined surface 6332 of the receiving groove 6330, thereby enabling the rotation prevention pin 6350 to be prevented from being separated outward after insertion.

According to another embodiment, a plurality of rotation prevention pins 6350 may be formed on the seal ring 6340. As illustrated in FIG. 6, it is preferable that the plurality of rotation prevention pins 6350 are arranged on the seal ring 6340 to be disposed according to a certain circumferential interval around the seal ring 6340.

As is apparent from the above description, in accordance with the rotor disk assembly of the present disclosure, it is possible to enhance the sealing capability between the disks and maintain the sealing capability even when the disks are radially displaced due to thermal expansion or the like.

In addition, it is possible to simplify a manufacturing process since the groove is formed in only one of two adjacent labyrinth arms.

Another object of the present disclosure is to provide a rotor disk assembly capable of maintaining a sealing capability even though adjacent labyrinth arms are dislocated from each other due to torsion or the like by thermal expansion or rotation of rotor disks.

While the present disclosure has been described with respect to the specific embodiments, it will be apparent to those skilled in the art that various changes and modifications may be made without departing from the spirit and scope of the disclosure as defined in the following claims.

What is claimed is:

1. A rotor disk assembly for a gas turbine, comprising:

a seal ring;

at least one rotation prevention pin; and a plurality of rotor disks axially assembled to each other, the plurality of rotor disks including a pair of adjacent rotor disks coupled to each other by Hirth parts, each rotor disk of the pair of adjacent rotor disks comprising two labyrinth arms that extend axially and bilaterally and are located on the rotor disk more radially outward than the Hirth parts, wherein the two labyrinth arms include a first labyrinth arm having an end surface in which a receiving groove for receiving the seal ring is formed by a first surface formed on a radially outward side of the receiving groove and inclined with respect to the end surface of the first labyrinth arm, a second surface formed on a radially inward side of the receiving groove and inclined with respect to the end surface of the first labyrinth arm, and a vertex at which the first and second surfaces meet, the end surface of the first labyrinth arm having the receiving groove being formed opposite to a second labyrinth arm having a flat end such that the receiving groove is formed only in the first labyrinth arm, wherein the vertex of the receiving groove is recessed by an insertion groove for receiving the at least one rotation prevention pin, and wherein the insertion groove is inclined with respect to the end surface of the first labyrinth arm.

2. The rotor disk assembly according to claim 1, wherein the two labyrinth arms include the second labyrinth arm that is formed opposite to the first labyrinth arm and has the flat end, and wherein the flat end of the second labyrinth arm of one rotor disk of the pair of adjacent rotor disks and the end surface of the first labyrinth arm of the other rotor disk of the pair of adjacent rotor disks are separated from each other by a gap.

3. The rotor disk assembly according to claim 2, wherein the seal ring has a size greater than a depth of the receiving groove, such that a difference between the size of the seal ring and the depth of the receiving groove is greater than a distance of the gap.

4. The rotor disk assembly according to claim 2, wherein the seal ring is configured to cover the gap by increasing in radial size when a rotor rotates.

5. The rotor disk assembly according to claim 1, wherein the receiving groove has an axially cut cross-section having a conical shape.

6. The rotor disk assembly according to claim 1, wherein the at least one rotation prevention pin consists of a plurality of rotation prevention pins arranged around the seal ring.

7. The rotor disk assembly according to claim 1, wherein the receiving groove includes a stepped portion formed radially outside the second surface of the receiving groove and configured to prevent a separation of the at least one rotation prevention pin in a radially outward direction after insertion into an insertion groove.

8. The rotor disk assembly according to claim 1, wherein the seal ring is an elastic body.

9. The rotor disk assembly according to claim 1, wherein the first surface is inclined to form an obtuse angle with respect to the end surface of the first labyrinth arm, and wherein the second surface is inclined to form an obtuse angle with respect to the end surface of the first labyrinth arm.

10. A rotor disk for a gas turbine, comprising:

a disk plate;

Hirth parts circumferentially formed on front and rear surfaces of the disk plate and configured to be coupled to an adjacent disk plate;

a seal ring;

at least one rotation prevention pin; and labyrinth arms circumferentially formed on the disk plate to be located more radially outward than the Hirth parts, wherein the labyrinth arms comprise a first labyrinth arm formed on the front surface of the disk plate and a second labyrinth arm formed on the rear surface of the disk plate, the first labyrinth arm having an end surface in which a receiving groove for receiving the seal ring is formed and the second labyrinth arm having a flat end configured to face an end surface of a first labyrinth arm of the adjacent disk plate, wherein the receiving groove is formed by a first surface formed on a radially outward side of the receiving groove and inclined with respect to the end surface of the first labyrinth arm, a second surface formed on a radially inward side of the receiving groove and inclined with respect to the end surface of the first labyrinth arm, and a vertex at which the first and second surfaces meet, the end surface of the first labyrinth arm having the receiving groove being formed opposite to the flat end of the second labyrinth arm having a flat end such that the receiving groove is formed only in the first labyrinth arm, wherein the vertex of the receiving groove is recessed by an insertion groove for receiving the at least one rotation prevention pin, and wherein the insertion groove is inclined with respect to the end surface of the first labyrinth arm.

11. The rotor disk according to claim 10, wherein the seal ring has a size greater than a depth of the receiving groove, such that a difference between the size of the seal ring and the depth of the receiving groove is greater than a distance of a gap formed between the flat end of the second labyrinth arm and the end surface of the first labyrinth arm of the adjacent rotor disk.

12. The rotor disk according to claim 11, wherein the seal ring is configured to cover the gap by increasing in radial size when a rotor rotates.

13. The rotor disk according to claim 10, wherein the receiving groove has an axially cut cross-section having a conical shape.

14. The rotor disk according to claim 10, wherein the at least one rotation prevention pin consists of a plurality of rotation prevention pins arranged around the seal ring.

15. The rotor disk according to claim 10, wherein the receiving groove includes a stepped portion formed radially outside the second surface of the receiving groove and configured to prevent a separation of the at least one rotation prevention pin in a radially outward direction after insertion into an insertion groove.

16. The rotor disk according to claim 10, wherein the seal ring is an elastic body.

17. The rotor disk according to claim 10, wherein a pressure cavity is defined between the labyrinth arms and the Hirth parts.

18. The rotor disk according to claim 10, wherein the first surface is inclined to form an obtuse angle with respect to the end surface of the first labyrinth arm, and wherein the second surface is inclined to form an obtuse angle with respect to the end surface of the first labyrinth arm.

* * * * *